US005400958A

United States Patent [19]

Walker

[11] Patent Number: 5,400,958

[45] Date of Patent: Mar. 28, 1995

[54] MAILBOXES ROTATABLE TO ANY ONE OF A PLURALITY OF ORIENTATIONS

[76] Inventor: Kevin G. Walker, 113 Crestview Dr., Bellefonte, Pa. 16823

[21] Appl. No.: 203,823

[22] Filed: Mar. 1, 1994

[51] Int. Cl.[6] ..... B65D 91/00

[52] U.S. Cl. ..... 232/39; 248/131

[58] Field of Search ..... 232/17, 39; 108/94, 108/22; 248/131, 349, 900

[56] References Cited

U.S. PATENT DOCUMENTS

| | | | |
|---|---|---|---|
| 877,066 | 1/1908 | Scobee | 248/131 |
| 885,460 | 4/1908 | Felknor | 248/131 |
| 1,240,190 | 9/1917 | Forth | 248/131 |
| 3,407,997 | 10/1968 | Wood | 232/39 |
| 4,606,619 | 8/1986 | Yamana | 248/900 |
| 4,893,747 | 1/1990 | Roth | 232/39 |

FOREIGN PATENT DOCUMENTS

| | | | |
|---|---|---|---|
| 1240429 | 5/1967 | Germany | 248/900 |

*Primary Examiner*—Flemming Saether

[57] ABSTRACT

A mailbox rotatable to any one of a plurality of orientations comprising, a top plate having an upper surface and a lower surface and with apertures therethrough and with supplemental apertures; a bottom plate in a generally configuration having an upper surface and a lower surface and with apertures therethrough and with supplemental apertures; a upper disk having an upper surface and a lower surface and with apertures extending therethrough for coupling the upper surface of the upper disk to the lower surface of the top plate through the supplemental apertures, the lower surface of the disk being provided with a downwardly extending projection at a predetermined distance from the axis of the upper disk; a lower disk having a thickness greater than that of the upper disk and with a central bore therethrough, the bore being of a greater diameter in its lower extent to create a shoulder intermediate the upper and lower surfaces; apertures formed adjacent to the periphery of the lower disk for securing the lower surface of the lower disk to the upper surface of the bottom plate, the upper surface of the lower disk being formed with a plurality of recesses for selectively receiving the projection of the upper disk, the recesses being at the predetermined distance from the axis of the upper disk and lower disk; and a cylinder with an enlargement at its lower end positioned within the bore of the lower disk and with threaded apertures extending downwardly into its upper surface for being coupled to the upper disk by bolts extending through the apertures of the upper disk.

3 Claims, 3 Drawing Sheets

MAILBOXES ROTATABLE TO ANY ONE OF A PLURALITY OF ORIENTATIONS

BACKGROUND OF THE INVENTION

1. Field of the Invention

The present invention relates to new and improved mailboxes rotatable to any one of a plurality of orientations and more particularly pertains to rotating a mailbox to any one of a plurality of rotational orientations for the convenience of a user.

2. Description of the Prior Art

The use of mailboxes with adjustment components is known in the prior art. More specifically, mailboxes with adjustment components heretofore devised and utilized for the purpose of repositioning mailboxes are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,167,364 to Wenning relates to a rotatable mounting assembly for a rural mailbox.

U.S. Pat. No. 4,995,576 to Kieswetter relates to mounting for a roadside mailbox.

U.S. Pat. No. 4,995,534 to Raible discloses a swivel mail box.

U.S. Pat. No. 4,667,918 to Page relates to a rotatable mailbox pedestal.

U.S. Pat. No. 3,999,702 to Conroy discloses a mailbox standard.

U.S. Pat. No. 3,802,656 to Virblas relates to a mailbox support.

In this respect, the mailboxes rotatable to any one of a plurality of orientations according to the present invention substantially depart from the conventional concepts and designs of the prior art, and in doing so provides an apparatus primarily developed for the purpose of rotating a mailbox to any one of a plurality of rotational orientations for convenience of a user.

Therefore, it can be appreciated that there exists a continuing need for new and improved mailboxes rotatable to any one of a plurality of orientations which can be used for rotating a mailbox to any one of a plurality of rotational orientations for convenience of a user. In this regard, the present invention substantially fulfills this need.

SUMMARY OF THE INVENTION

In view of the foregoing disadvantages inherent in the known types of mailboxes with adjustment components now present in the prior art, the present invention provides improved mailboxes rotatable to any one of a plurality of orientations. As such, the general purpose of the present invention, which will be described subsequently in greater detail, is to provide a new and improved mailbox rotatable to any one of a plurality of orientations and method which has all the advantages of the prior art and none of the disadvantages.

To attain this, the present invention essentially comprises a new and improved mailbox rotatable to any one of a plurality of orientations comprising, in combination, a rectangular top plate having an upper surface and a lower surface and with apertures therethrough for coupling with a mailbox thereabove and with supplemental apertures; a rectangular bottom plate having an upper surface and a lower surface and with apertures therethrough for coupling with a mail box post therebeneath and with supplemental apertures; a circular upper disk having an upper surface and a lower surface and with apertures extending therethrough for coupling the upper surface of the upper disk to the lower surface of the top plate through the supplemental apertures, the lower surface of the upper disk being provided with a downwardly extending hemispherical projection at a predetermined distance from the axis of the upper disk; a circular lower disk having a thickness greater than that of the upper disk and with a central bore therethrough, the bore being of a greater diameter in its lower extent to create a shoulder intermediate the upper and lower surfaces; apertures formed adjacent to the periphery of the lower disk for securing the lower surface of the lower disk to the upper surface of the bottom plate, the upper surface of the lower disk being formed with a plurality of hemispherical recesses for selectively receiving the projection of the upper disk, the recesses being at the predetermined distance from the axis of the upper disk and lower disk; an inverted T shaped cylinder with an enlargement at its lower end positioned within the bore of the lower disk and with threaded apertures extending downwardly into its upper surface for being coupled to the upper disk by bolts extending through the interior apertures of the upper disk; and a coil spring located within the bore between the enlargement of the cylinder and the shoulder of the lower disk to thereby exert a pressure to hold together the upper and lower disks and, consequently, for holding the projection into a preselected recess of the lower disk.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved mailboxes rotatable to any one of a plurality of orientations which have all the advantages of the prior art mailboxes with adjustment components and none of the disadvantages.

It is another object of the present invention to provide new and improved mailboxes rotatable to any one of a plurality of orientations which may be easily and efficiently manufactured and marketed.

It is further object of the present invention to provide new and improved mailboxes rotatable to any one of a plurality of orientations which are of durable and reliable constructions.

An even further object of the present invention is to provide new and improved mailboxes rotatable to any one of a plurality of orientations which are susceptible of a low cost of manufacture with regard to both materials and labor, and which accordingly are then susceptible of low prices of sale to the consuming public, thereby making such mailbox rotatable to any one of a plurality of orientations economically available to the buying public.

Still yet another object of the present invention is to provide new and improved mailboxes rotatable to any one of a plurality of orientations which provide in the apparatuses and methods of the prior art some of the advantages thereof, while simultaneously overcoming some of the disadvantages normally associated therewith.

Still another object of the present invention is to rotate a mailbox to any one of a plurality of rotational orientations.

Lastly, it is an object of the present invention to provide new and improved mailboxes rotatable to any one of a plurality of orientations comprising, a top plate having an upper surface and a lower surface and with apertures therethrough and with supplemental apertures; a bottom plate in a generally configuration having an upper surface and a lower surface and with apertures therethrough and with supplemental apertures; a upper disk having an upper surface and a lower surface and with apertures extending therethrough for coupling the upper surface of the upper disk to the lower surface of the top plate through the supplemental apertures, the lower surface of the disk being provided with a downwardly extending projection at a predetermined distance from the axis of the upper disk; a lower disk having a thickness greater than that of the upper disk and with a central bore therethrough, the bore being of a greater diameter in its lower extent to create a shoulder intermediate the upper and lower surfaces; apertures formed adjacent to the periphery of the lower disk for securing the lower surface of the lower disk to the upper surface of the bottom plate, the upper surface of the lower disk being formed with a plurality of recesses for selectively receiving the projection of the upper disk, the recesses being at the predetermined distance from the axis of the upper disk and lower disk; and a cylinder with an enlargement at its lower end positioned within the bore of the lower disk and with threaded apertures extending downwardly into its upper surface for being coupled to the upper disk by bolts extending through the apertures of the upper disk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
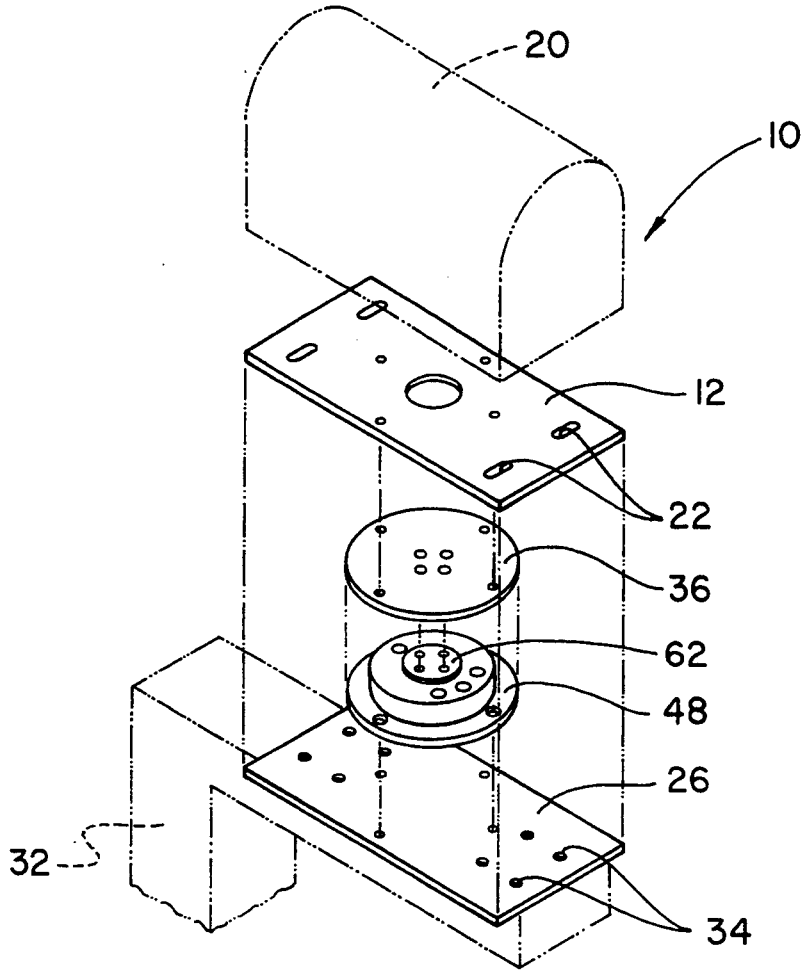
FIG. 1 is a exploded perspective view of the preferred embodiment of the new and improved mailbox rotatable to any one of a plurality of orientations constructed in accordance with the principles of the present invention.
Figure 2:
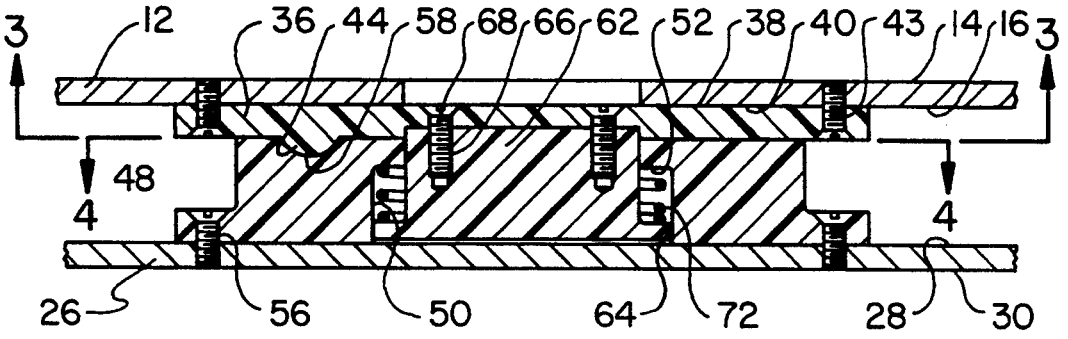
FIG. 2 is a cross-sectional view taken vertically through the mechanisms coupling rotation imparting mechanisms of FIG. 1.
Figure 3:
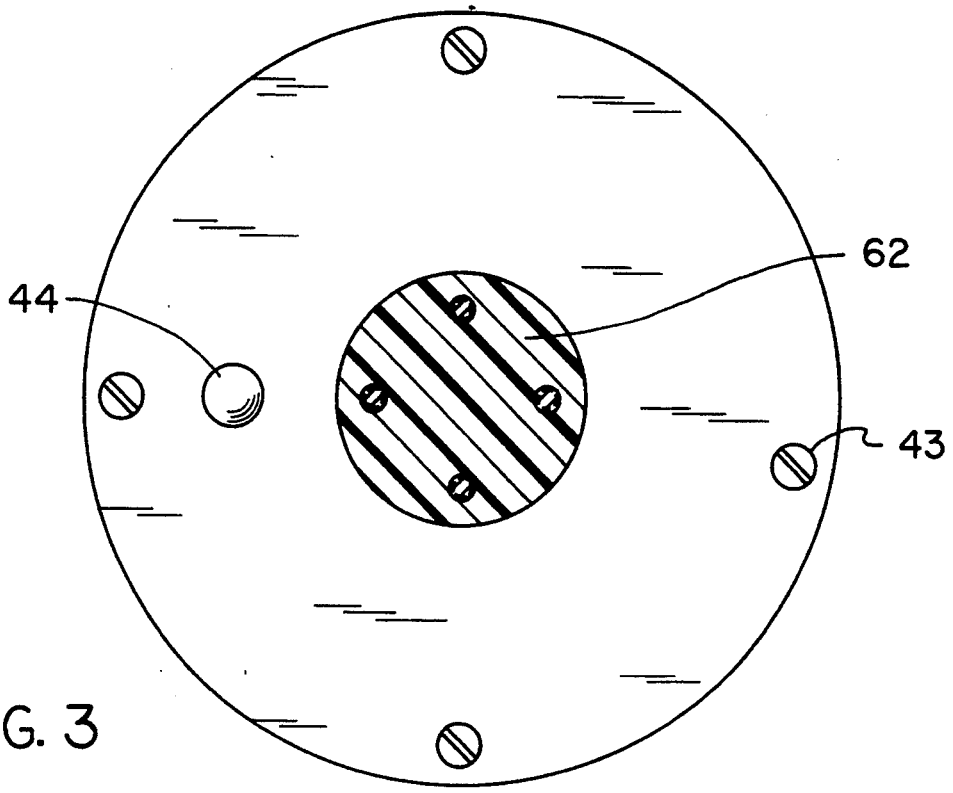
FIG. 3 is a cross-sectional view taken along line 3—3 of FIG. 2.
Figure 4:
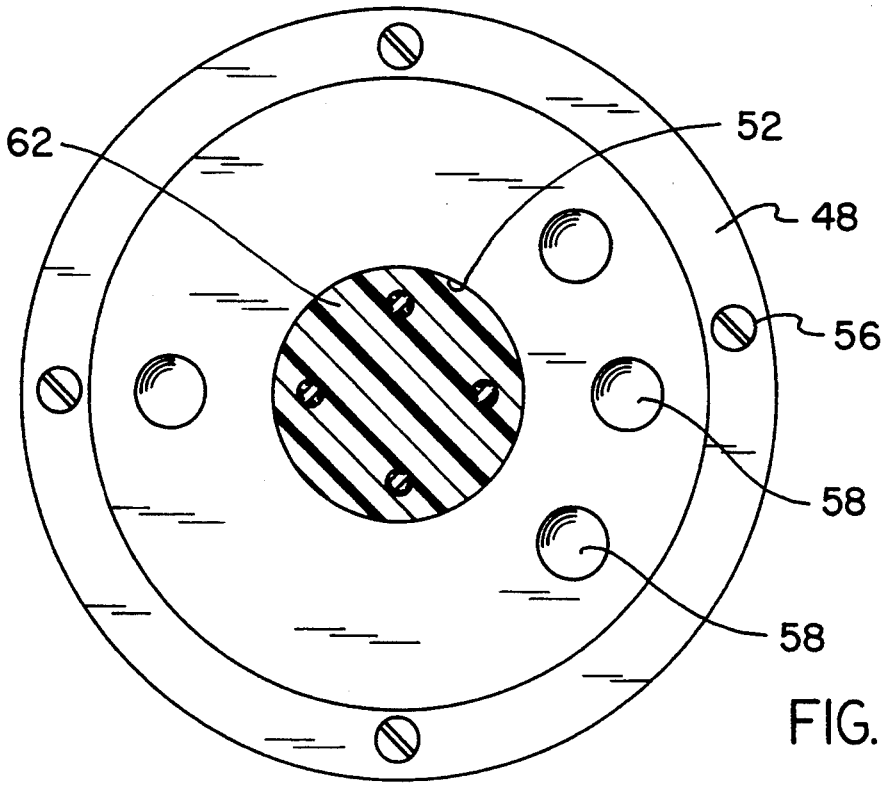
FIG. 4 is a cross-sectional view taken along line 4—4 of FIG. 2.
Figure 5:
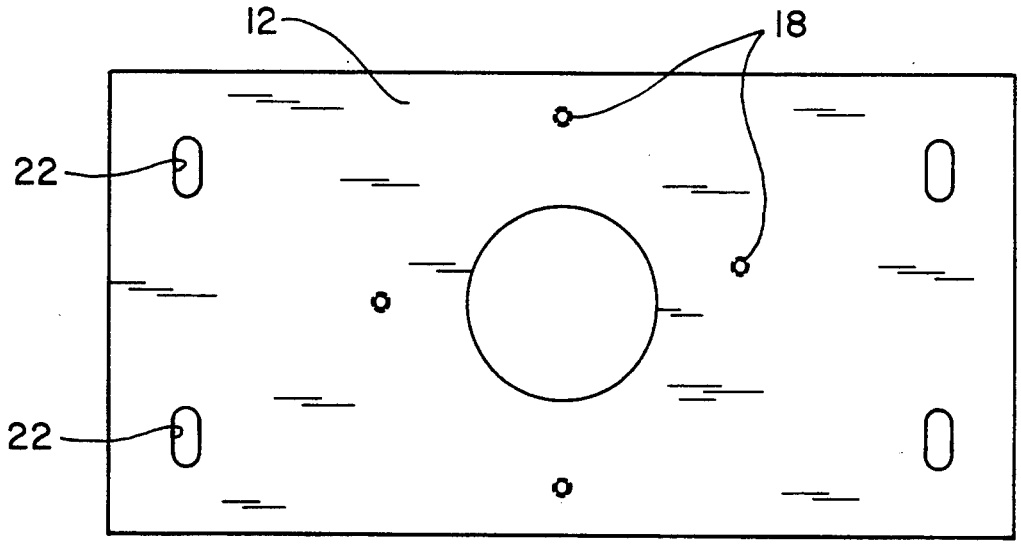
FIG. 5 is a plan view of the top plate immediately beneath the mailbox of FIG. 1.
Figure 6:
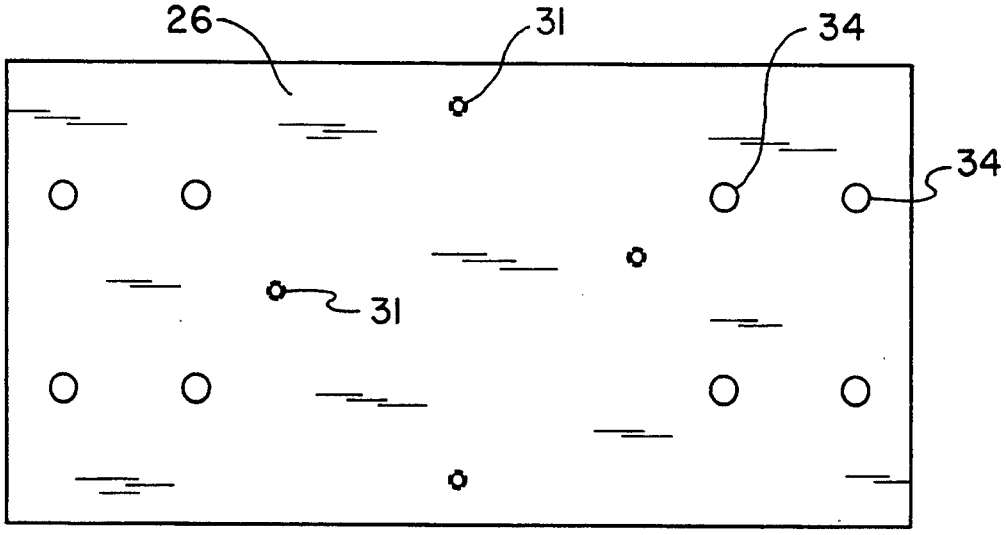
FIG. 6 is a plan view of the bottom plate located immediately above the mailbox post.

With reference now to the drawings, and in particular to FIG. 1 thereof, the preferred embodiment of the new and improved mailbox rotatable to any one of a plurality of orientations embodying the principles and concepts of the present invention and generally designated by the reference numeral 10 will be described.

Specifically, the present invention the new and improved mailboxes rotatable to any one of a plurality of orientations comprises a plurality of individual components. In their broadest context, the individual components include a top plate, a bottom plate, a upper disk, a lower disk, apertures in the various components, a cylinder and a spring. The individual components are specifically configured and correlated one with respect to the other to achieve the desired objectives.

More specifically, the rectangular top plate 12 is formed with an upper surface 14 and a lower surface 16. It has apertures 18 extending therethrough for coupling with a mailbox 20. The mailbox is located thereabove. The top plate also has supplemental apertures 22 extending therethrough.

In addition, there is also provided a rectangular bottom plate 26. The upper and lower plates are of a similar configuration. The bottom plate has an upper surface 28 and a lower surface 30. It also has apertures 31 therethrough. Like the top plate, the bottom plate is also provided with supplemental apertures 34 for coupling with a mailbox post 32 located therebeneath.

An upper disk 36 in a circular configuration is next provided. It has an upper surface 38 and a lower surface 40. It has apertures 42 extending therethrough for coupling the upper surface of the upper disk to the lower surface of the top plate. Such is done through the supplemental apertures. The lower surface of the upper disk is provided with a downwardly extending hemispherical projection 44. The projection is at a predetermined distance from the axis of the upper disk.

Next provided is a circular lower disk 48. Such lower disk has a thickness greater than that of the upper disk. It has a central bore 50 extending therethrough. The bore is centrally located and is of a greater diameter in its lower extent than its upper extent so as to create a shoulder 52 intermediate the upper and lower surfaces.

Formed adjacent to the periphery of the lower disk are a plurality of apertures 56. Such apertures are for securing the lower surface of the lower disk to the upper surface of the bottom plate. The upper surface of the lower disk is formed with a plurality of hemispherical recesses 58 corresponding in size to the projection of the upper disk. The recesses are for selectively receiving the projection. To achieve this, the recesses are located at a predetermined distance from the axis of the upper disk which is the axis of the lower disk.

Located within the bore of the lower disk is an inverted T-shaped cylinder 62. Such cylinder is formed with an enlargement 64 at its lower end. It is positioned within the bore of the lower disk. Such cylinder is also formed with threaded apertures 66 extending downwardly into its upper surface. Such threaded apertures are for being coupled to the upper disk by threaded bolts 68. Such threaded bolts extend through the supplemental apertures of the upper disk.

Lastly, provided is a coil spring 72. Such coil spring is located within the bore between the enlargement of the cylinder and the shoulder of the lower disk. The coil spring functions to exert a pressure to hold together the upper and lower disks. Because of this force, a force is provided for holding the projection into a preselected recess of the lower disk, the recess to which it has been last rotated by the user.

The product is a swivel joint and hardware plate to attach existing mailboxes to. It will enable the person getting mail from their box to simply turn the mailbox 180 degrees and remove mail, then rotate it back facing the road. This was developed to prevent homeowners from having to go out onto or into a street and possibly be at risk of getting hit by a vehicle. With the mailbox rotatable to any one of a plurality of orientations, all one has to do is simply turn the mailbox one half turn, it will then lock into place by way of a notch and bearing mechanism, possibly teflon coated to operate smoothly and to prevent any metal parts from rusting, then simply remove mail while staying in yard and then return mailbox to original position by turning back one half turn.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved mailbox rotatable to any one of a plurality of orientations comprising, in combination:

a rectangular top plate having an upper surface and a lower surface and with apertures therethrough for coupling with a mailbox thereabove, the top plate also having supplemental apertures;

a rectangular bottom plate having an upper surface and a lower surface and with apertures therethrough for coupling with a mail box post therebeneath, the bottom plate also having supplemental apertures;

a circular upper disk having a central axis and having an upper surface and a lower surface and with apertures extending therethrough for coupling the upper surface of the upper disk to the lower surface of the top plate through the supplemental apertures thereof, the lower surface of the upper disk being provided with a downwardly extending hemispherical projection at a predetermined distance from the axis of the upper disk, the upper disk also having interior apertures;

a circular lower disk having a central axis coaxial with the central axis of the upper disk and having upper and lower surfaces and having a thickness greater than that of the upper disk and with a central bore therethrough, the bore being of a greater diameter in its lower extent to create a shoulder intermediate the upper and lower surfaces;

apertures formed adjacent to a periphery of the lower disk for securing the lower surface of the lower disk to the upper surface of the bottom plate, the upper surface of the lower disk being formed with a plurality of hemispherical recesses for selectively receiving the projection of the upper disk, the recesses being at the same predetermined distance from the axis of the lower disk as the projection from the axis of the upper disk;

a cylinder with an enlargement at a lower end positioned within the bore of the lower disk and with threaded apertures extending downwardly into its upper surface for being coupled to the upper disk by bolts extending through the interior apertures of the upper disk; and a coil spring located within the bore between the enlargement of the cylinder and the shoulder of the lower disk to thereby exert a pressure to hold together the upper and lower disks and, consequently, for holding the projection into a preselected recess of the lower disk.

2. A mailbox rotatable to any one of a plurality of orientations comprising:

a top plate having an upper surface and a lower surface and with apertures therethrough, the top plate also having supplemental apertures;

a bottom plate in a generally configuration having an upper surface and a lower surface and with apertures therethrough, the bottom plate also having supplemental apertures;

an upper disk having a central axis and also having an upper surface and a lower surface and with apertures extending therethrough for coupling the upper surface of the upper disk to the lower surface of the top plate through the supplemental apertures thereof, the lower surface of the disk being provided with a downwardly extending projection at a predetermined distance from the axis of the upper disk;

a lower disk having upper and lower surfaces and having having a central axis coaxial with the central axis of the upper disk and having a thickness greater than that of the upper disk and with a central bore therethrough, the bore being of a greater diameter in a lower extent to create a shoulder intermediate the upper and lower surfaces;

apertures formed adjacent to a periphery of the lower disk for securing the lower surface of the lower disk to the upper surface of the bottom plate, the upper surface of the lower disk being formed with a plurality of recesses for selectively receiving the projection of the upper disk, the recesses being at the same predetermined distance from the axis of the lower disk as the projection from the axis of the upper disk; and a cylinder with an enlargement at a lower end positioned within the bore of the lower disk and with threaded apertures extending downwardly into its upper surface for being coupled to the upper disk by bolts extending through the apertures of the upper disk.

3. The device as set forth in claim 2 and further including:

resilient means located within the bore between the enlargement of the cylinder and the shoulder of the lower disk to thereby exert a pressure to hold together the upper and lower disk and, consequently, for holding the projection into a preselected recess of the lower disk.

* * * * *